US011427935B2

(12) United States Patent
Tseng

(10) Patent No.: US 11,427,935 B2
(45) Date of Patent: Aug. 30, 2022

(54) PASSIVE INTERMITTENT ROTATING ASSEMBLY AND ELECTROSPINNING EQUIPMENT

(71) Applicant: TAIPEI MEDICAL UNIVERSITY, Taipei (TW)

(72) Inventor: How Tseng, Taipei (TW)

(73) Assignee: TAIPEI MEDICAL UNIVERSITY, Taipei (TW)

( * ) Notice: Subject to any disclaimer, the term of this patent is extended or adjusted under 35 U.S.C. 154(b) by 42 days.

(21) Appl. No.: 17/200,321

(22) Filed: Mar. 12, 2021

(65) Prior Publication Data

US 2022/0170180 A1 Jun. 2, 2022

(30) Foreign Application Priority Data

Dec. 1, 2020 (TW) ..... 109142300

(51) Int. Cl.
*D01D 4/04* (2006.01)
*D01D 5/00* (2006.01)

(52) U.S. Cl.
CPC ..... *D01D 4/04* (2013.01); *D01D 5/0069* (2013.01)

(58) Field of Classification Search
CPC ..... D01D 4/04; D01D 5/0069; D01D 13/02; D01D 5/0007; B65G 47/90
See application file for complete search history.

(56) References Cited

U.S. PATENT DOCUMENTS 1,975,504 A * 10/1934 Formhals ..... D01D 5/0076 425/174
2,109,333 A * 2/1938 Formhals ..... D01D 5/0092 425/174
2,116,942 A * 5/1938 Formhals ..... D01D 7/00 425/174
2,123,992 A * 7/1938 Formhals ..... D01D 5/0076 425/174

(Continued)

FOREIGN PATENT DOCUMENTS

CN 208183122 U 12/2018
CN 208183123 U 12/2018

(Continued)

*Primary Examiner* — Matthew J Daniels
*Assistant Examiner* — Shibin Liang
(74) *Attorney, Agent, or Firm* — Muncy, Geissler, Olds & Lowe, P.C.

(57) ABSTRACT

A passive intermittent rotating assembly can automatically adjust a part of a cleaning material when the cleaning material cleans a spinning jet each time and that can stably operate in a high-voltage environment. The passive intermittent rotating assembly includes a plurality of first abutment members and second abutment members being arranged respectively at an inner side and outer side of the main wheel along the circumferential direction, and being separated from each other to form gaps for a push portion of a push member to pass through. Each of the first abutment members includes a first inner-side abutment portion and a first outer-side abutment portion provided for abutting against the push portion. Each of the second abutment members includes a second inner-side abutment portion and a second outer-side abutment portion provided for abutting against the push portion.

11 Claims, 8 Drawing Sheets

(56) References Cited

U.S. PATENT DOCUMENTS

| | | | | | |
|---|---|---|---|---|---|
| 2,158,415 | A * | 5/1939 | Formhals | ..... | D01D 5/0092 422/186.04 |
| 2,158,416 | A * | 5/1939 | Formhals | ..... | D01D 5/0069 422/186.04 |
| 2,160,962 | A * | 6/1939 | Formhals | ..... | D01D 5/0076 422/186.04 |
| 2,187,306 | A * | 1/1940 | Formhals | ..... | D02G 3/36 427/415 |
| 2018/0202073 | A1 * | 7/2018 | Sakamoto | ..... | D01D 4/04 |
| 2018/0250718 | A1 | 9/2018 | Sakai | | |

FOREIGN PATENT DOCUMENTS

| | | | | | |
|---|---|---|---|---|---|
| CN | 109879044 | * | 6/2019 | ..... | B65G 47/90 |
| JP | 2002088561 | A | 3/2002 | | |
| JP | 2008202169 | * | 9/2008 | ..... | D01D 4/04 |

* cited by examiner

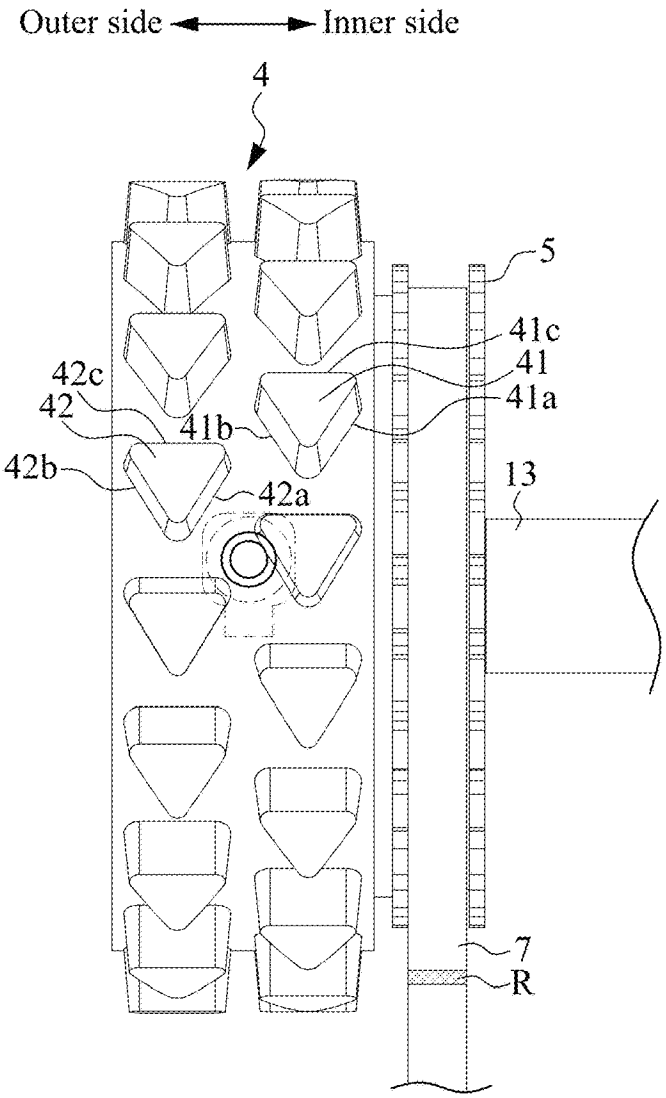
FIG. 4F
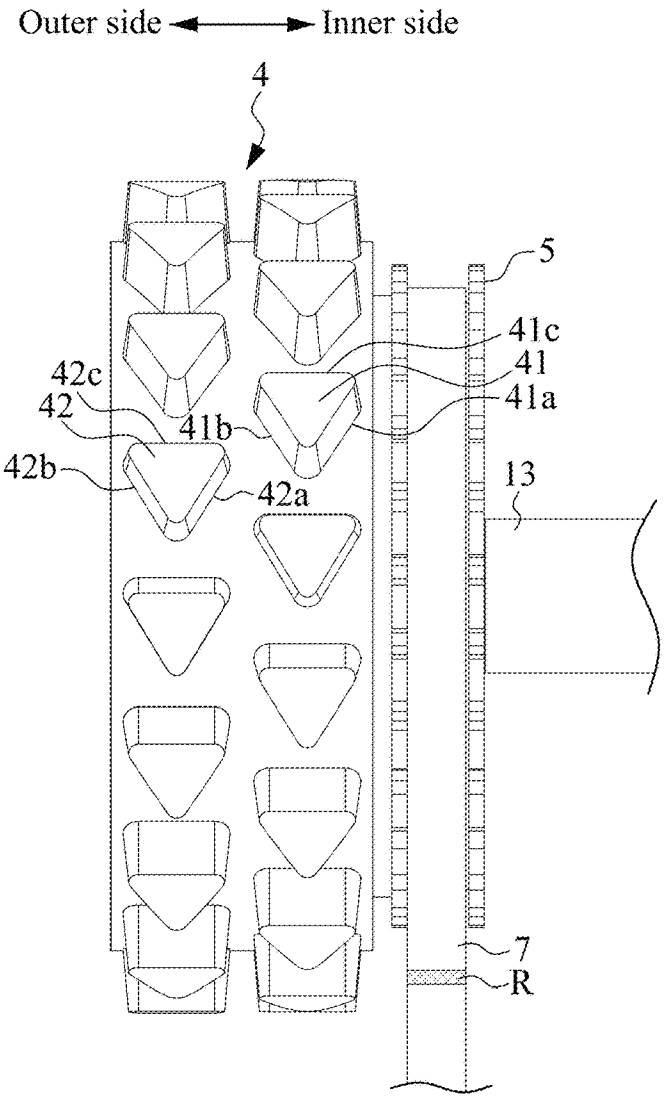
FIG. 4E
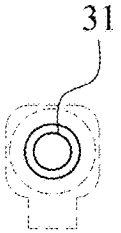

PASSIVE INTERMITTENT ROTATING ASSEMBLY AND ELECTROSPINNING EQUIPMENT

BACKGROUND OF THE INVENTION

1. Field of the Invention

The present invention relates to a passive intermittent rotating assembly, and in particular, to a structure of a passive intermittent rotating mechanism of an intermittent rotating assembly used for cleaning a spinning jet of an electrospinning equipment.

2. Description of the Related Art

Electrostatic spinning, also referred to as electrospinning, is a technology of applying a voltage on a liquid to manufacture a micron-level or nanometer-level superfine fiber from the liquid. Electrospun fibers manufactured by using the electrospinning technology have such characteristics as extremely small diameters, highly porous, and high surface area ratio. Therefore, the fibers are quite suitable for manufacturing nanometer fiber masks or biomedical products such as an artificial blood vessel based on biocompatibility.

An electrospinning equipment configured to manufacture electrospun fibers by using electrospinning technology includes one or a plurality of spinning jets like injector needles. The spinning jet is usually connected to a high-voltage (usually 5 to 50 kV) direct current power supply, and is provided with a pump device and a grounded negative electrospun fiber collecting device. During manufacturing of electrospun fibers, macromolecular solutions used by the electro spinning equipment such as a polymer solution, a sol-gel, a suspension, or a molten liquid are injected into an injector. The amount of liquid flowing from the needle of the injector is kept constant through control of the pump. Then, a voltage is applied to the liquid in the injector, and electrospun fibers are ejected from a nozzle of the spinning jet and are collected by the electrospun fiber collecting device.

SUMMARY OF THE INVENTION

The Problem to be Resolved in the Present Invention

Due to viscosity and rapid volatility of a macromolecular solution, the macromolecular solution easily solidifies to form dried residue blocks stacked on a nozzle of a spinning jet of an electrospinning equipment. Due to the extremely fine pore size of the nozzle, after a period of time, the nozzle may be partially blocked, causing problems such as an unstable electrospinning process and poor quality of electrospun fibers. Therefore, how to regularly clean the spinning jet to keep the nozzle clean is an important subject for the electrospinning process.

Previously, a spinning jet is usually cleaned by scraping residues manually using a soft cleaning material. However, the method is labor-consuming and time-consuming, and because it is difficult for a cleaner to accurately control a position of the cleaning material relative to the spinning jet, and the residues on the spinning jet are scraped repeatedly by using a same part of the cleaning material, the residues accumulating on the same part of the cleaning material are re-attached to the spinning jet. As a result, the spinning jet cannot be cleaned effectively.

Therefore, recently, developers dispose an electric intermittent rotating assembly beside an electrospinning equipment. When the cleaning material cleans a spinning jet, the electric electrospinning equipment adjusts a position of a cleaning material each time to avoid a case that a same part of the cleaning material is used repeatedly to clean the spinning jet by using an electrical device such as a motor as a power source. However, the electrical device such as a motor needs to be disposed near a spinning jet having a high voltage together with the intermittent rotating assembly, and the electrical device easily breaks down in this environment, resulting in a poor cleaning effect.

In addition, a spinning jet is a part of a spinning device of an electrospinning equipment. The spinning device moves back and forth in a horizontal direction of a body portion by using a movable device of the body portion of the electrospinning equipment for spinning, and can be in contact with the foregoing cleaning material on the passive intermittent rotating assembly during the moving. A power source of the movable device of the body portion of the electrospinning equipment does not need to be mounted near the spinning jet. Therefore, the power source will not be affected by a high voltage and break down. However, the power source is relatively far away from the spinning jet and the cleaning material, so it is difficult to use the power source of the movable device as a power source for adjusting the position of the cleaning material.

The present invention is completed based on the foregoing conditions, and the objective of the present invention is to provide a passive intermittent rotating assembly that can automatically adjust, without an additional a power source, a part of the cleaning material each time when the cleaning material cleans a spinning jet and can stably operate in a high-voltage environment.

Technical Means for Resolving the Problem

To enable a passive intermittent rotating assembly to automatically adjust a part of a cleaning material each time when the cleaning material cleans a spinning jet and stably cleans the spinning jet in a high-voltage environment, the method of adjusting the part of the cleaning material each time when the cleaning material cleans the spinning jet by using an electrical device such as a motor is abandoned, and a technical solution of driving the cleaning material to rotate by using a mechanical passive structure is considered.

First, the inventor considered a passive intermittent rotating assembly including a cleaning material for cleaning a spinning jet of a spinning device of electrospinning equipment, a front winding wheel and a rear winding wheel separately rotatably supported on the electrospinning equipment and provided for winding the cleaning material, a main wheel coaxially rotating with the front winding wheel and having a plurality of abutment members formed on an outer circumferential surface, and a push member fixed on the spinning device to move back and forth along an axial direction of the main wheel with the spinning jet whose push portion abuts against the abutment members and thereby enables the main wheel to rotate in a process of moving back and forth. The plurality of abutment members are arranged along a circumferential direction and are separated from each other to form gaps for the push portion to pass through. Each of the abutment members comprises an inner-side abutment portion and an outer-side abutment portion provided for abutting against the push portion and converging toward the opposite direction of rotation of the main wheel.

In this way, as shown in FIG. 5, when the spinning jet moves towards the cleaning material 7 to scrape residues on the spinning jet, the push portion 31 linked with the spinning jet also moves towards an outer side of the main wheel 4. When the push portion 31 is in contact with the abutment member 40 of the main wheel 4, the abutment member 40 will be pushed by the push portion 31, thereby driving the main wheel 4 to rotate. When the main wheel 4 rotates, the front winding wheel 5 for winding the cleaning material 7 is simultaneously driven by the main wheel 4 to rotate, so that a part of the cleaning material 7 is adjusted each time when the cleaning material 7 cleans the spinning jet.

However, there still exists the following problem in the passive intermittent rotating assembly. After the push portion 31 passed an end of the inner-side abutment portion 40*a* of the abutment member 40, if the main wheel 4 continues to rotate by inertia, then the push portion 31 may still abut against the outer-side abutment portion 40*b* of another abutment member 40 during a returning process back to the initial position. However, if the inertia of the main wheel 4 is insufficient or excessive, the push portion 31 could just directly pass through the gap between the abutment members 40 and cannot enable the main wheel 4 to rotate again, no matter in a process in which the push portion 31 returns to the initial position, or in a process in which the push portion 31 leaves the initial position again and moves towards the main wheel 4 for a second cleaning, resulting in a failure in an operation for adjusting the part of the cleaning material 7.

Therefore, the inventor focused on how to enable the push portion to be stably in contact with the abutment members during every repeated movement without using an electrical device, and conducted deliberate researches, resulting in an invention capable of resolving the foregoing problem. The following describes the invention.

A passive intermittent rotating assembly according to a first embodiment of the present invention includes: a cleaning material, used for cleaning a spinning jet of a spinning device of an electrospinning equipment; a front winding wheel and a rear winding wheel, separately rotatably supported on the electrospinning equipment and provided for the cleaning material to be wound on; a main wheel coaxially rotating with the front winding wheel, and abutment members being formed on an outer circumferential surface; and a push member supported by the spinning device to move back and forth along an axial direction of the main wheel with the spinning jet, and in a process of moving back and forth, a push portion of the push member abutting against the abutment members and pushing the main wheel to rotate, wherein the abutment members comprises: a plurality of first abutment members being arranged at an inner side of the main wheel along a circumferential direction, and being separated from each other to form gaps for the push portion to pass through; and a plurality of second abutment members being arranged at an outer side of the main wheel along the circumferential direction, and being separated from each other to form gaps for the push portion to pass through; each of the first abutment members comprises a first inner-side abutment portion and a first outer-side abutment portion provided for abutting against the push portion and converging toward the opposite direction of rotation of the main wheel; each of the second abutment members comprises a second inner-side abutment portion and a second outer-side abutment portion provided for abutting against the push portion and converging toward the opposite direction of rotation of the main wheel; and when observing from the axial direction of the main wheel, there is no gap in the circumferential direction between the first inner-side abutment portion and two closest second inner-side abutment portions or there is only a gap smaller than half the length of the push portion in a horizontal direction, and there is no gap in the circumferential direction between the first outer-side abutment portion and two closest second outer-side abutment portions or there is only a gap smaller than half the length of the push portion in the horizontal direction.

According to the first embodiment of the present invention, the push member supported by the spinning device to move back and forth along an axial direction of the main wheel with the spinning jet is used to push the main wheel to rotate, and the abutment members formed on the outer circumferential surface of the main wheel includes a plurality of first abutment members arranged at the inner side of the main wheel along the circumferential direction and a plurality of second abutment members arranged at the outer side of the main wheel along a circumferential direction. When observing from the axial direction of the main wheel, there is no gap in the circumferential direction between the first inner-side abutment portion of the first abutment members and the two closest second inner-side abutment portions of the second abutment members or there is only a gap smaller than half the length of the push portion in a horizontal direction, and there is no gap in the circumferential direction between the first outer-side abutment portion of the first abutment members and the two closest second outer-side abutment portions of the second abutment members or there is only a gap smaller than half the length of the push portion in the horizontal direction. Therefore, after moving in the axial direction of the main wheel and passing through the gap between the first inner-side abutment portions of the two first abutment members, the push portion will definitely abut against the second inner-side abutment portion of the second abutment member to enable the main wheel to rotate towards a pre-determined direction, and after passing through the gap between the second out-side abutment portions of the two second abutment members, the push portion will definitely abut against the first outer-side abutment portion of the first abutment member to enable the main wheel to rotate towards the pre-determined direction. Therefore, no matter in a process in which the push portion returns to an initial position, or in a process in which the push portion leaves the initial position again and moves towards the main wheel for a second cleaning, the push portion can enable again the main wheel to rotate, so that an operation of adjusting the part of the cleaning material can be stably performed.

In this way, the push portion of the passive intermittent rotating assembly in the present invention can be in contact with the abutment portion of the abutment member in a process of repeated movements with the spinning jet. Therefore, the main wheel can stably and intermittently rotate to change the relative position of the spinning jet and the cleaning material and automatically adjusts the part of the cleaning material to clean the spinning jet, without being driven by an electrical device. As a result, it is able to stably clean the spinning jet under a high-voltage environment.

Regarding a second embodiment of the present invention, two ends of the second inner-side abutment portion in the circumferential direction are further forward and rearward respectively than the gap between the two closest first abutment members in the rotation direction of the main wheel; and two ends of the first outer-side abutment portion in the circumferential direction are further forward and rearward respectively than the gap between the two closest second abutment members in the rotation direction of the main wheel.

According to the second embodiment of the present invention, two ends of an abutment portion in a circumferential direction are further forward and rearward respectively than two ends of the closest (that is, overlapping in the axial direction of the main wheel) gap. After the push portion passes through the gap between the two first abutment members, if a case in which the main wheel performs an unexpected reverse rotation due to an external force occurs, the push portion can still abut against the abutment portion of the second abutment member to enable the main wheel to rotate. On the contrary, in a process of returning to the initial position, after passing through the gap between the two second abutment members, the push portion can still abut against the abutment portion of the first abutment member to enable the main wheel to rotate. In this way, the push portion of the passive intermittent rotating assembly of the present invention can get into contact with the abutment portion of the abutment member more stably in a process of repeated movements with the spinning jet.

Regarding a passive intermittent rotating assembly in a third embodiment of the present invention, the first abutment member has a first front-side abutment portion at the downstream side in the rotation direction of the main wheel; the second abutment member has a second front-side abutment portion at the downstream side in the rotation direction of the main wheel; the first front-side abutment portion and the second front-side abutment portion are formed in parallel to the axial direction of the main wheel; and the diameter of the push member is substantially the same as the gap between the first abutment members and the gap between the second abutment members.

According to the third embodiment of the present invention, even if the main wheel having a relatively small friction generated during rotation is used, after passing through the gap between the first abutment members or the gap between the second abutment members, the push member will keep abutting against the first front-side abutment portion of the rearward first abutment members for a while and therefore prevents the main wheel from keeping rotating Similarly, the push member will keep abutting against the second front-side abutment portion of the rearward second abutment members for a while and therefore prevents the main wheel from keeping rotating. Therefore, an unnecessary relative displacement between the push member and the gap caused by an inertial rotation of the main wheel after the push member passes through the gap between the first abutment members or the gap between the second abutment members can be avoided.

The passive intermittent rotating assembly according to a fourth embodiment of the present invention further includes an adjusting rod configured to adjust a tension of the cleaning material wound on the front winding wheel and the rear winding wheel.

According to the fourth embodiment of the present invention, the adjusting rod can be properly adjusted according to a requirement, a tension of the cleaning material when the cleaning material is wound on the front winding wheel and the rear winding wheel, so that the cleaning material of the passive intermittent rotating assembly of the present invention can be in contact with the spinning jet more precisely and can rotate more stably.

Regarding a passive intermittent rotating assembly according to a fifth embodiment of the present invention, in a top view, the shape of the first abutment member is substantially an inverted triangle formed by the first inner-side abutment portion, the first outer-side abutment portion, and the first front-side abutment portion; and in a top view, the shape of the second abutment member is substantially an inverted triangle formed by the second inner-side abutment portion, the second outer-side abutment portion, and the second front-side abutment portion.

Electrospinning equipment according to a sixth embodiment of the present invention includes: the passive intermittent rotating assembly according to any one of the first to fifth embodiments; a body portion comprising a movable device; and a spinning device comprising a spinning jet and moving back and forth horizontally by the movable device to get into contact with the cleaning material of the passive intermittent rotating assembly.

BRIEF DESCRIPTION OF THE DRAWINGS

FIG. 4A to FIG. 4H are views showing a process of pushing an abutment member by a push portion to rotate a main wheel.

DETAILED DESCRIPTION OF THE PREFERRED EMBODIMENTS

Overall Structure of Electrospinning Equipment

Figure 1:
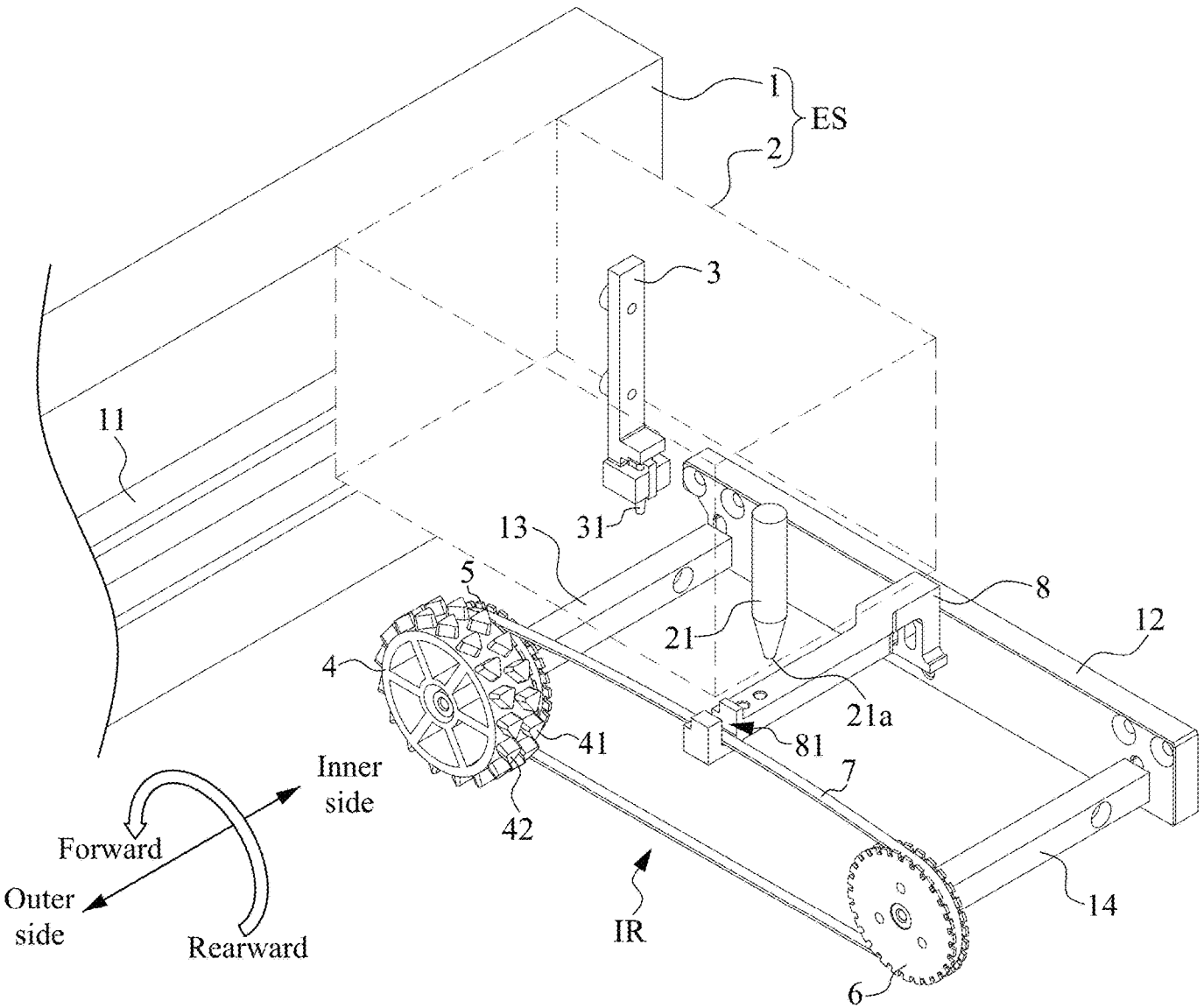
FIG. 1 is a schematic perspective view of an electrospinning equipment with an intermittent rotating assembly according to the present invention.
Figure 2:
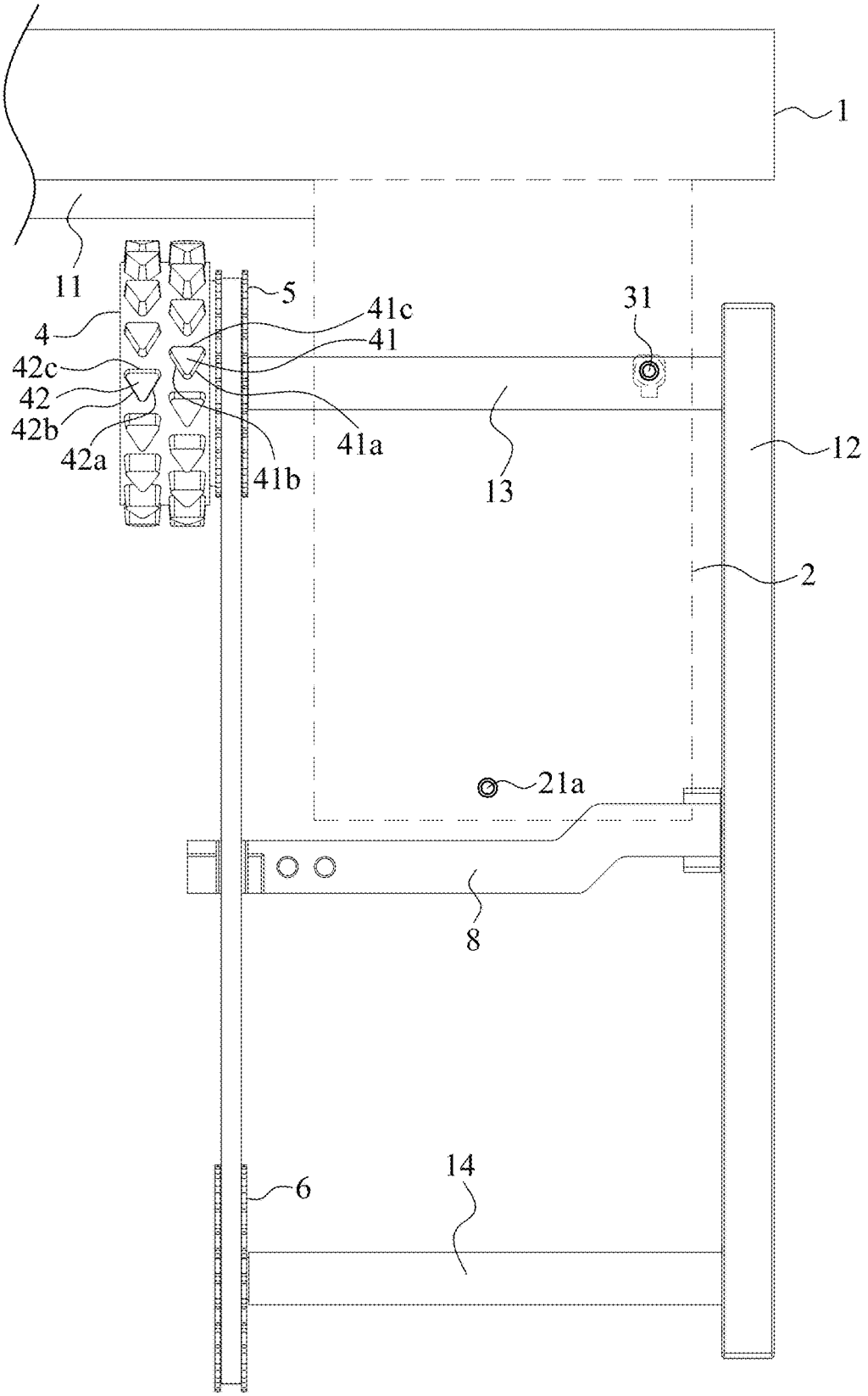
FIG. 2 is a schematic top view of an electrospinning equipment with an intermittent rotating assembly according to the present invention.

First, an overall structure of an intermittent rotating assembly applied to an electrospinning equipment according to an embodiment is briefly described with reference to FIG. 1 and FIG. 2. FIG. 1 is a schematic perspective view of an electrospinning equipment ES with an intermittent rotating assembly according to the present invention. FIG. 2 is a schematic top view of an electrospinning equipment ES with an intermittent rotating assembly according to the present invention. As shown in FIG. 1 and FIG. 2, the electrospinning equipment ES includes a body portion 1 and a spinning device 2. The spinning device 2 includes a spinning jet 21 having a nozzle 21*a*. The body portion 1 includes a movable device 11, a side wall portion 12, a front winding wheel support portion 13, and a rear winding wheel support portion 14. The movable device 11 enables the spinning device 2 to move in a horizontal direction relative to the body portion 1 and brings the nozzle 21*a* into contact with a cleaning material 7 of an intermittent rotating assembly IR described below. The side wall portion 12 is fixed on a side of the body portion 1 of the electrospinning equipment ES, and is provided for fixing the front winding wheel support portion 13 and the rear winding wheel support portion 14 described below. The front winding wheel support portion 13 is configured to support a front winding wheel 5 of the intermittent rotating assembly IR described below. The rear winding wheel support portion 14 is configured to support a rear winding wheel 6 of the intermittent rotating assembly IR described below. In this embodiment, the front winding wheel support portion 13 and the rear winding wheel support portion 14 are disposed extending in a direction (an axial direction of a main wheel 4 of the intermittent rotating assembly IR described below) parallel to a movement direction of the spinning device 2. In addition, in FIG. 1 and FIG. 2, to more clearly present an overall structure of the intermittent rotating assembly IR described below, the spinning device 2 is represented by using dashed lines, and only the spinning jet 21 is represented by using a solid line.

Overall Structure of the Intermittent Rotating Assembly

Figure 3:
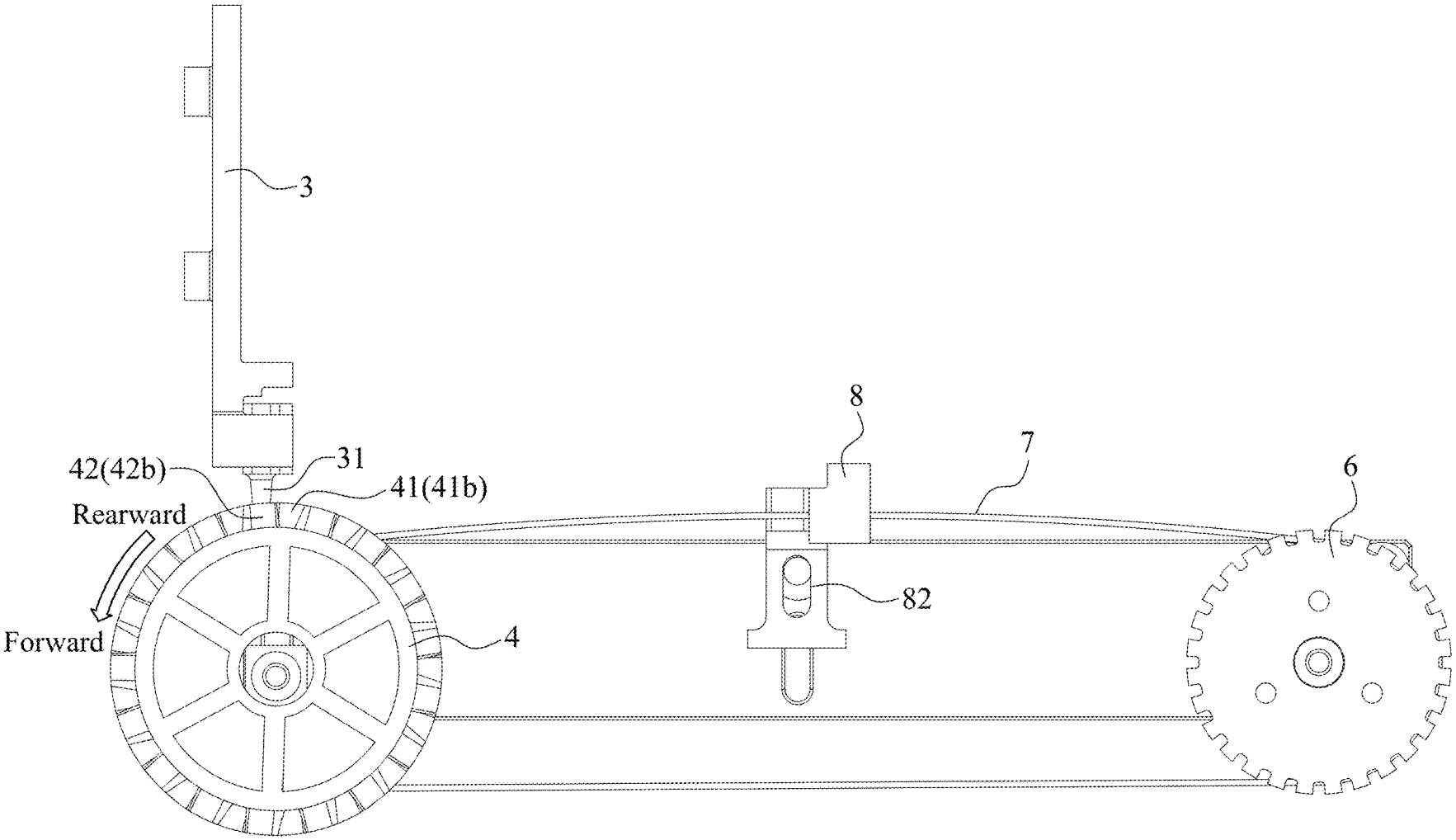
FIG. 3 is a side view of an intermittent rotating assembly according to the present invention.

Second, the intermittent rotating assembly IR in this embodiment is described with reference to FIG. 1 to FIG. 3. FIG. 3 is a side view of an intermittent rotating assembly IR according to the present invention. The intermittent rotating assembly IR in this embodiment includes: a push member 3, a main wheel 4, a front winding wheel 5, a rear winding wheel 6, and a cleaning material 7. The cleaning material 7 is used for cleaning a spinning jet 21 of the spinning device 2 of an electrospinning equipment ES. The front winding wheel 5 and the rear winding wheel 6 are separately rotatably supported on the electrospinning equipment ES and provided for the cleaning material 7 to be wound on. The main wheel 4 coaxially rotates with the front winding wheel 5, and a plurality of first abutment members 41 and a plurality of second abutment members 42 are formed on an outer circumferential surface. The diameter of the front winding wheel 5 is less than the diameter of the main wheel 4 including the first abutment member 41 and the second abutment member 42. The push member 3 is supported by the spinning device 2 to move back and forth along an axial direction of the main wheel 4 with the spinning jet 21, and in a process of moving back and forth, a push portion 31 of the push member 3 abuts against the first abutment member 41 and the second abutment member 42 and then pushes the main wheel 4 to rotate. The first abutment members 41 are arranged at an inner side of the main wheel 4 along a circumferential direction, and the first abutment members 41 are separated from each other to form gaps for the push portion 31 to pass through. The second abutment members 42 are arranged at an outer side of the main wheel 4 along a circumferential direction, and the second abutment members 42 are separated from each other to form gaps for the push portion 31 to pass through. Each of the first abutment members 41 includes a first inner-side abutment portion 41*a* and a first outer-side abutment portion 41*b* provided for abutting against the push portion 31 and converging toward the opposite direction of rotation of the main wheel 4. Each of the second abutment members 42 includes a second inner-side abutment portion 42*a* and a second outer-side abutment portion 42*b* provided for abutting against the push portion 31 and converging toward the opposite direction of rotation of the main wheel 4. More specifically, the first inner-side abutment portion 41*a* and the first outer-side abutment portion 41*b* form bevels which approach the center of the first abutment member 41 as they extend toward the opposite direction of rotation of the main wheel 4, and the second inner-side abutment portion 42*a* and the second outer-side abutment portion 42*b* formed bevels which approach the center of the second abutment member 42 as they extend toward the opposite direction of rotation of the main wheel 4. Further, when observing from the axial direction of the main wheel 4, there is no gap in the circumferential direction between the first inner-side abutment portion 41*a* and the two closest second inner-side abutment portions 42*a* or there is only a gap smaller than half the length of the push portion 31 in the horizontal direction (namely, the width of the push portion 31 shown in FIG. 3), and there is no gap in the circumferential direction between the first outer-side abutment portion 41*b* and the two closest second outer-side abutment portions 42*b* or there is only a gap smaller than half the length of the push portion 31 in the horizontal direction (namely, the width of the push portion 31 shown in FIG. 3). In other words, the first abutment member 41 and the second abutment member 42 are alternately arranged on an outer circumferential surface of the main wheel 4. In the following descriptions, a side of the main wheel 4 close to the side wall portion 12 is defined as an inner side, and a side of the main wheel 4 far away from the side wall portion 12 is defined as an outer side. "Forward" means downstream of the rotation direction of the main wheel 4, and "Rearward" means upstream of the rotation direction of the main wheel 4.

Operation Process of the Intermittent Rotating Assembly

Referring to FIG. 2, FIG. 3, and FIG. 4A to FIG. 4H, the structure and operation of the intermittent rotating assembly IR in this embodiment are further described. As shown in FIG. 2 and FIG. 3, the initial position of the push portion 31 of the push member 3 in this embodiment is located close to a position of the side wall portion 12 and is located above the front winding wheel support portion 13. The spinning jet 21 of the spinning device 2 is located in the center of the spinning device 2, and therefore, the spinning jet 21 is closer to the cleaning material 7 than the push portion 31. However, the embodiments of the present invention are not limited thereto. The initial position of the push portion 31 may alternatively be closer to the cleaning material 7 than the spinning jet 21.

When the spinning device 2 operates, the push member 3 moves towards the main wheel 4 in the axial direction of the main wheel 4 with the spinning device 2 as the spinning device 2 moves. In a case that the spinning device 2 operates for the first time, when the push member 3 moves to a position near the main wheel 4, as shown in FIG. 4A, the push portion 31 may be in contact with the first inner-side abutment portion 41*a* of the first abutment member 41, because the first inner-side abutment portion 41*a* has a bevel which approaches the center of the first abutment member 41 as they extend toward the opposite direction of the rotation of the main wheel 4 (that is, a direction perpendicular to the movement direction of the push portion 31 and toward an intersection of the cleaning material 7 and the nozzle 21*a* in FIG. 4A). When the push portion 31 that can only move in the axial direction of the main wheel 4 abuts against the first inner-side abutment portion 41*a*, the first abutment member 41 moves towards a direction (that is, the front in the rotation direction of the main wheel 4) that is perpendicular to the movement direction of the push portion 31 and far away from the intersection of the cleaning material 7 and the nozzle 21*a* in FIG. 4A, to drive the main wheel 4 to rotate. The front winding wheel 5 coupled with the main wheel 4 coaxially rotates with the main wheel 4 simultaneously. Therefore, the cleaning material 7 to be wound on the front winding wheel 5 also moves towards the front in the rotation direction, so that a relative position between the spinning jet 21 and the cleaning material 7 changes (refer to FIG. 4A and FIG. 4B for a position change of a reference region R of the cleaning material 7, where an actual position change of the reference region R differs according to a difference in the diameter ratio of the front winding wheel 5 to the main wheel 4).

Figure 4B:
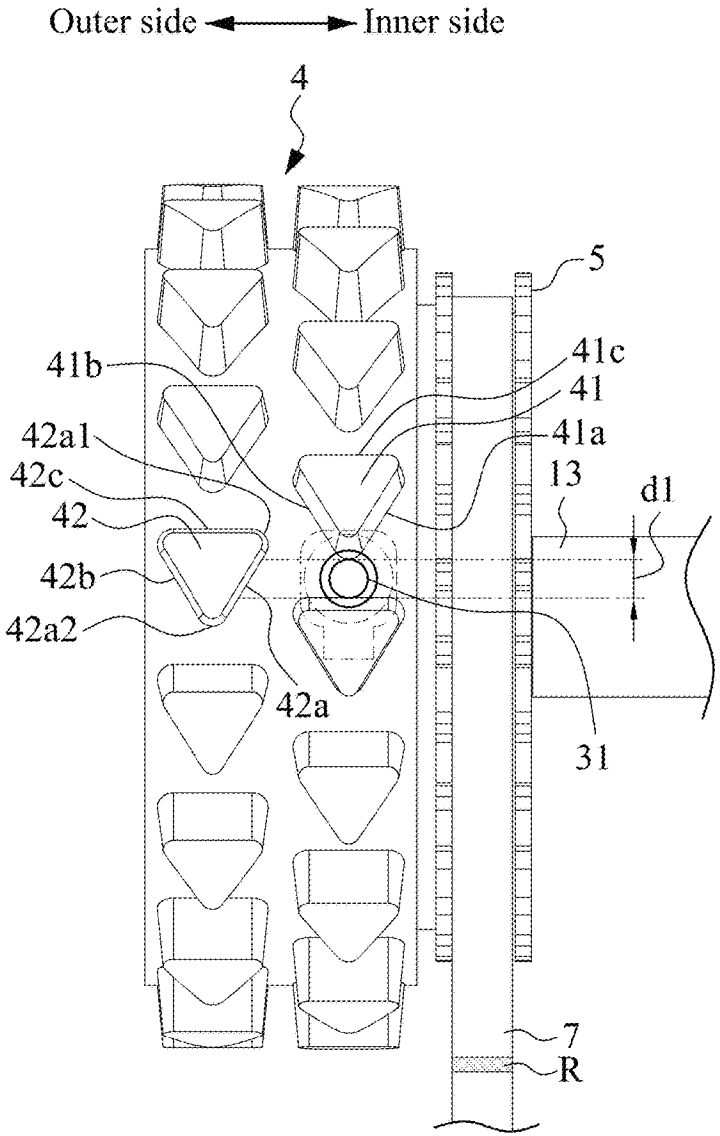
Figure 4A:
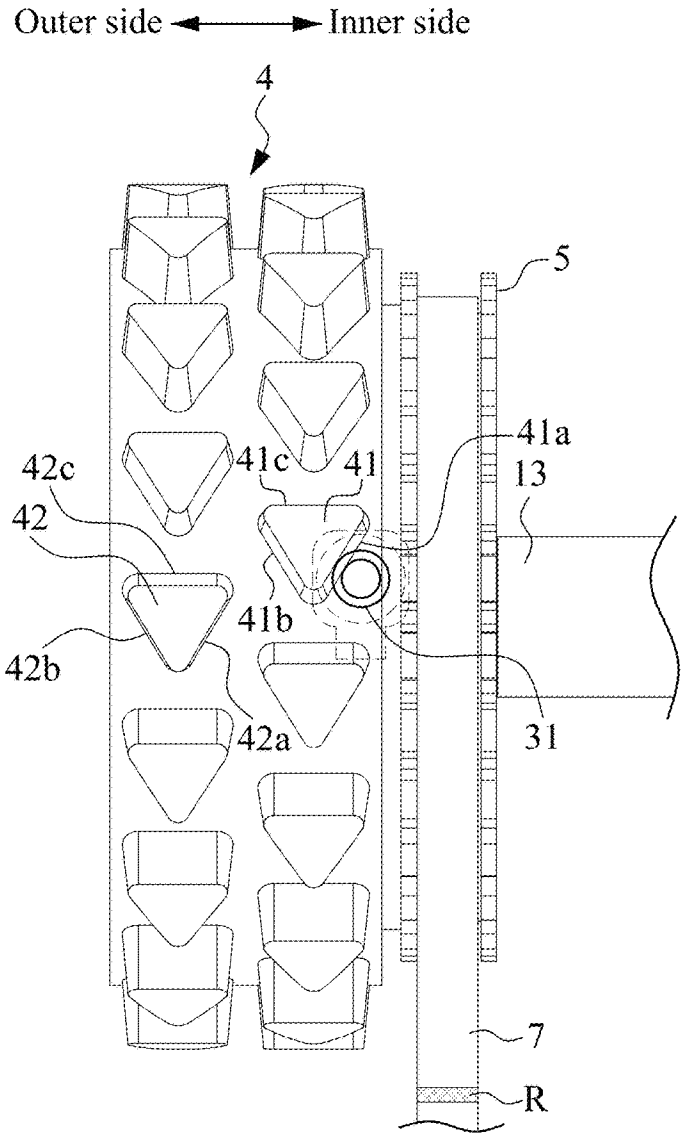
Figure 4D:
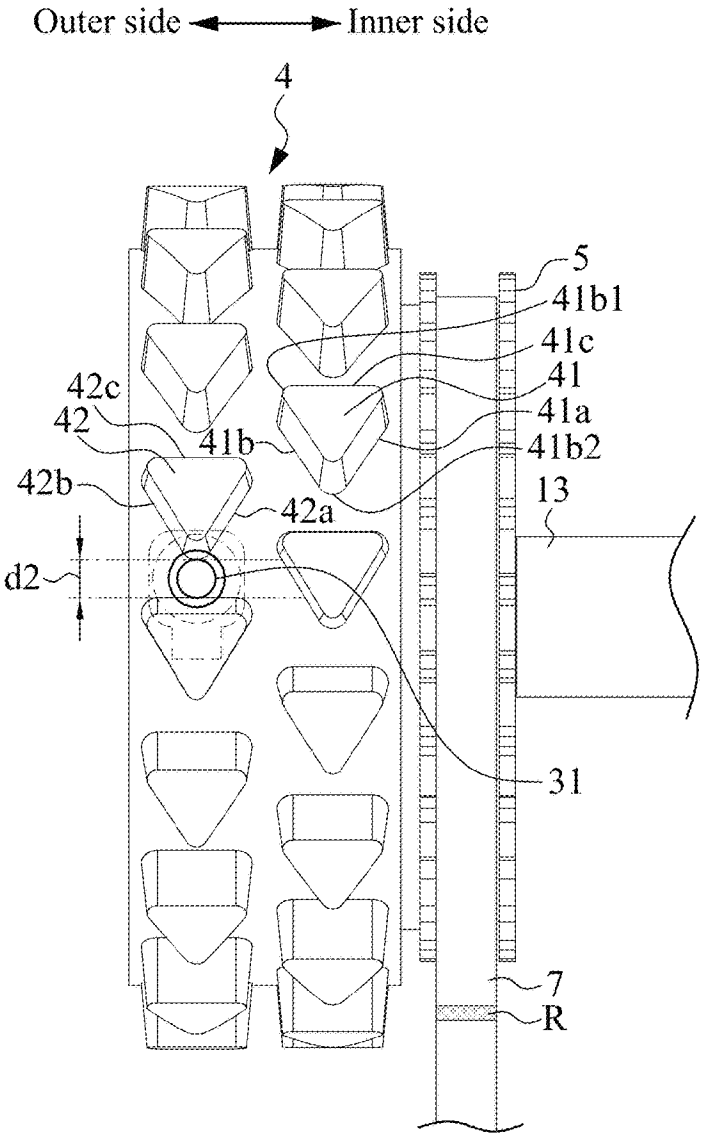
Figure 4C:
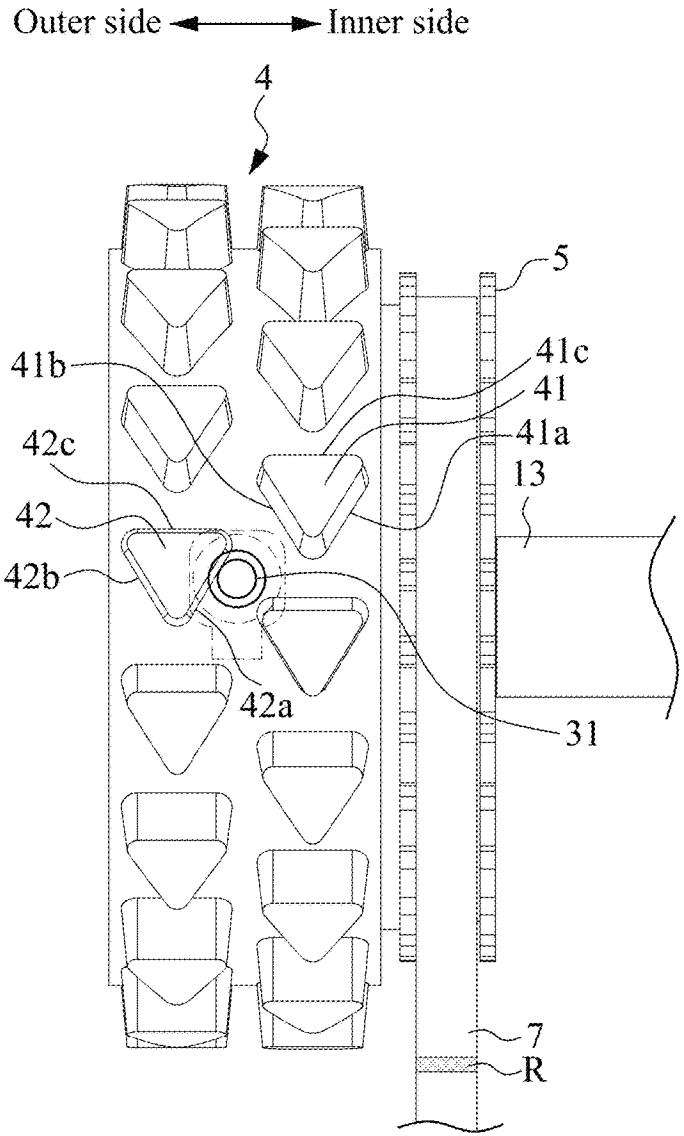

Then, as shown in FIG. 4B, the push portion 31 passes through a gap between the first abutment member 41 in contact with the push portion 31 and another first abutment member 41 located rearward, and reaches the second inner-side abutment portion 42*a* of the second abutment member 42 as shown in FIG. 4C Similarly, the second abutment member 42 is enabled to move forward in the rotation direction and drive the main wheel 4 to rotate (refer to FIG. 4C and FIG. 4D for the position change of the reference region R of the cleaning material 7). Finally, after passing through the gap between the second abutment members 42 as shown in FIG. 4D, the push portion 31 passes through the outer circumferential surface of the entire main wheel 4 as shown in FIG. 4E.

Figure 4H:
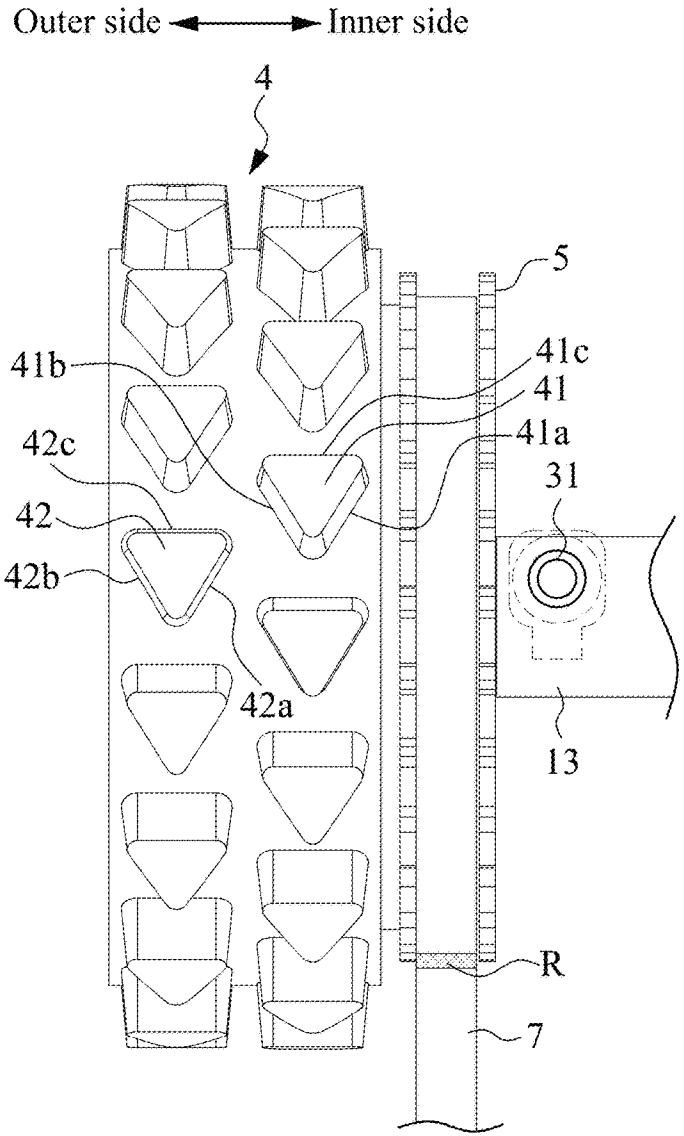
Figure 4G:
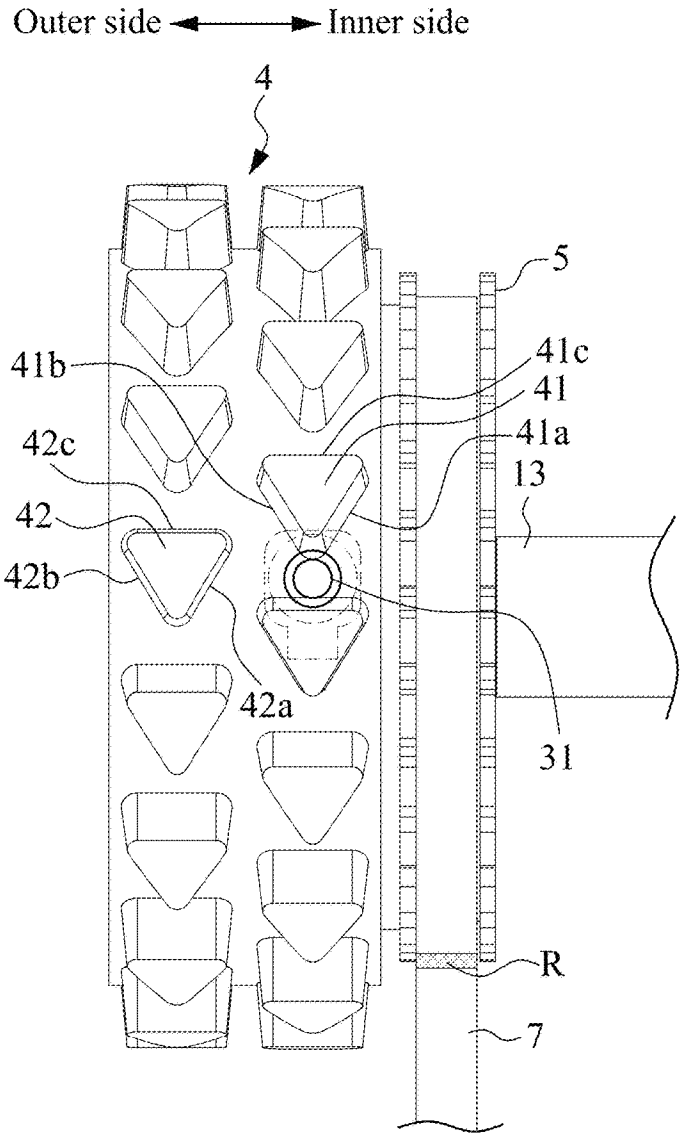
Figure 5:
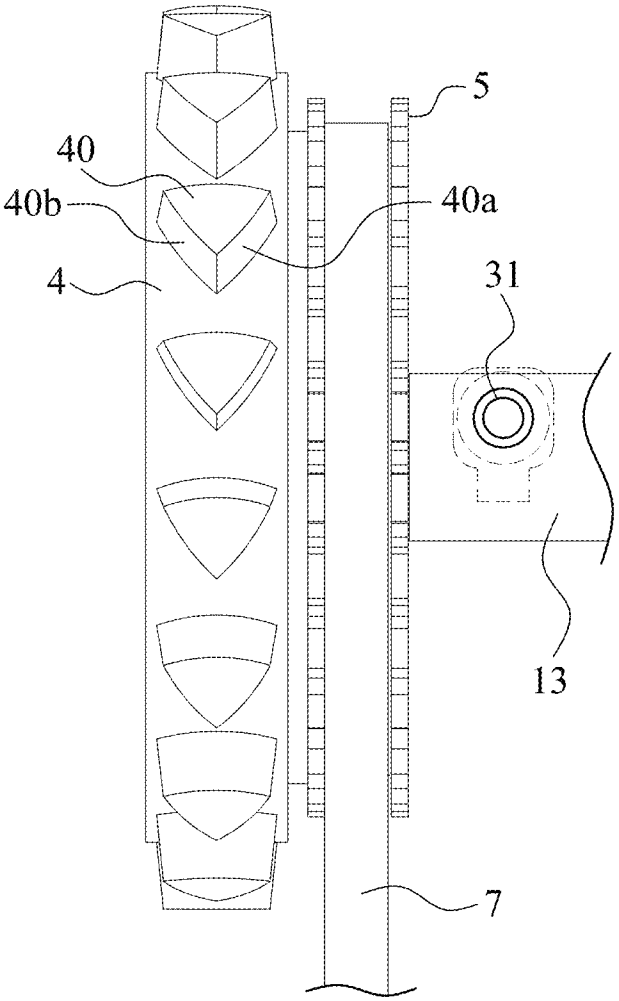
FIG. 5 is a schematic view of an initial concept of an intermittent rotating assembly concerning the present invention.

After the spinning device 2 finishes electrospinning operation, as shown in FIG. 4F, the push member 3 moves (returns) towards the initial position with the spinning device 2. Because the main wheel 4 is not pushed anymore after the action illustrated in FIG. 4D, in principle, the push portion 31 of the push member 3 directly passes through the same gap between the two second abutment members 42 as that in FIG. 4D, and then contacts the first outer-side abutment portion 41*b* of the first abutment member 41. In this case, as shown in FIG. 4G, the first abutment member 41 moves forward in the rotation direction and drives the main wheel 4 to rotate (refer to FIG. 4F and FIG. 4G for the position change of the reference region R of the cleaning material 7). Finally, as shown in FIG. 4H, the push portion 31 passes through the outer circumferential surface of the entire main wheel 4 and returns to its initial position.

When the spinning device 2 operates again, the spinning jet 21 and the push portion 31 move towards a direction far away from the initial position for another spinning jet cleaning In this case, because the main wheel 4 is not pushed anymore after the action illustrated in FIG. 4D, basically the push portion 31 directly passes through the gap between the two first abutment members 41 as that in FIG. 4B and directly reaches the second abutment member 42. The operation shown in FIG. 4A is not repeated. Therefore, when the main wheel 4 is not interfered by external force, in principle, each time the push portion 31 moves towards the direction away from the initial position, the push portion 31 will directly be in contact only with the second abutment member 42 and pushes the main wheel 4 once. Afterwards, each time the push portion 31 moves towards the direction of returning to the initial position, the push portion 31 will contact the first abutment member 41 only and pushes the main wheel 4 once. However, the embodiments of the present invention are not limited thereto. Even if the main wheel 4 is interfered by external force and enables the push portion 31 to get into contact with the abutment member 41 twice in a process during which the push portion 31 moves towards the direction far away from the initial position or returns to the initial position as shown in FIG. 4A to FIG. 4C, the rotation stroke of the cleaning material 7 will be slightly increased, without affecting stability of the intermittently rotating function of the main wheel 4.

Further, when observing from the axial direction (a direction shown in FIG. 3) of the main wheel 4, there is no gap in the circumferential direction between the first inner-side abutment portion 41*a* of the first abutment member 41 and the two closest second inner-side abutment portions 42*a* of the second abutment members 42 or there is only a gap whose length is less than half the length of the push portion 31 in a horizontal direction, and there is no gap in the circumferential direction between the first outer-side abutment portion 41*b* of the first abutment member 41 and the two closest second outer-side abutment portions 42*b* of the second abutment members 42 or there is only a gap whose length is less than half the length of the push portion 31 in the horizontal direction. Therefore, after moving in the axial direction of the main wheel 4 and passing through a gap d1 (refer to FIG. 4B) between the first inner-side abutment portions 41*a* of the two first abutment members 41 from the inner side, the push portion 31 will definitely abuts against the second inner-side abutment portion 42*a* of the second abutment member 42 to enable the main wheel 4 to rotate towards a pre-determined direction, and after passing through a gap d2 (refer to FIG. 4D) between the second outer-side abutment portions 42*b* of the two second abutment members 42 from an outer side, the push portion 31 will definitely abuts against the first outer-side abutment portion 41*b* of the first abutment member 41 to enable the main wheel 4 to rotate towards the pre-determined direction. Therefore, no matter in a process in which the push portion 31 returns to an initial position, or in a process in which the push portion 31 leaves the initial position again due to re-operation of the spinning device 2 and passes through the main wheel 4, the push portion 31 can re-enable the main wheel 4 to rotate again, so that an operation of adjusting the part of the cleaning material 7 can be stably performed.

A preferred embodiment is as follows. A front endpoint 42*a*1 and a rear endpoint 42*a*2 of the second inner-side abutment portion 42*a* in the circumferential direction are further forward and rearward respectively (refer to FIG. 4B) than the gap d1 between the two closest first abutment members 41 in the rotation direction of the main wheel 4. A front endpoint 41*b*1 and a rear endpoint 41*b*2 of the first outer-side abutment portion 41*b* in the circumferential direction are further forward and rearward respectively (refer to FIG. 4D) than the gap d2 between the two closest second abutment members 42 in the rotation direction of the main wheel 4.

According to the foregoing structure, the front endpoint 42*a*1 and the rear endpoint 42*a*2 of the second inner-side abutment portion 42*a* in the circumferential direction are further forward and rearward respectively than the front end and the rear end of the closest gap d1 (that is, the gap d1 overlapping the second inner-side abutment portion 42*a* in the axial direction of the main wheel 4) in the rotation direction of the main wheel 4. After the push portion 31 passes through the gap between the two first abutment members 41, if a case in which the main wheel 4 performs an unexpected reverse rotation due to an external force occurs, the push portion 31 can still abut against the second inner-side abutment portion 42*a* of the second abutment member 42 to enable the main wheel 4 to rotate. On the contrary, in a process of returning to the initial position, after passing through the gap between the two second abutment members 42, the push portion 31 can still abut against the first outer-side abutment portion 41*b* of the first abutment member 41 to enable the main wheel 4 to rotate. In this way, the push portion 31 of the passive intermittent rotating assembly IR of the present invention can get into contact with the first abutment member 41 and the second abutment member 42 more stably in a process of repeated movements with the spinning jet 21.

Another preferred embodiment is as follows. As shown in FIG. 2 and

FIG. 4A to FIG. 4H, the first abutment member 41 and the second abutment member 42 are substantially in the shape of an inverted triangle in a top view.

More specifically, the first abutment member 41 further has a first front-side abutment portion 41*c* at the downstream side in the rotation direction of the main wheel 4; the second abutment member 42 has a second front-side abutment portion 42*c* at the downstream side in the rotation direction of the main wheel 4; and the first front-side abutment portion 41*c* and the second front-side abutment portion 42*c* are formed substantially in parallel to the axial direction of the main wheel 4. In a top view, the shape of the first abutment member 41 is substantially an inverted triangle formed by the first inner-side abutment portion 41*a*, the first outer-side abutment portion 41*b*, and the first front-side abutment portion 41*c*. Also in a top view, the shape of the second abutment member 42 is substantially an inverted triangle formed by the second inner-side abutment portion 42*a*, the second outer-side abutment portion 42*b*, and the second front-side abutment portion 42*c*. In addition, the diameter of the push portion 31 is substantially the same as the gap d1 between the first abutment members 41 and the gap d2 between the second abutment members 42. In this way, even if the main wheel 4 having a relatively small friction generated during rotation is used, after passing through the gap d1 between the first abutment members 41, the push portion 31 will keep abutting against the first front-side abutment portion 41*c* of the rearward first abutment members 41 for a while and therefore prevents the main wheel 4 from keeping rotating Similarly, after passing through the gap d2 between the second abutment members 42, the push portion 31 will keep abutting against the second front-side abutment portion 42*c* of the rearward second abutment members 42 for a while and therefore prevents the main wheel 4 from keeping rotating. Therefore, an unnecessary relative displacement between the push portion 31 and the gap caused by an inertial rotation of the main wheel 4 after the push portion 31 passes through the gap dl between the first abutment members 41 or the gap d2 between the second abutment members 42 can be avoided.

Another preferred embodiment is as follows. The intermittent rotating assembly IR further includes an adjusting rod 8. The adjusting rod 8 can properly adjust, according to a requirement, a tension of the cleaning material 7 when the cleaning material 7 is wound on the front winding wheel 5 and the rear winding wheel 6. As shown in FIG. 1, a notch 81 is provided on an outer side end of the adjusting rod 8. The notch 81 can receive the cleaning material 7. As shown in FIG. 3, the adjusting rod 8 is disposed on the side wall portion 12 in a manner of being capable of moving up and down by using a height adjusting mechanism 82. When the adjusting rod 8 moves upward by using the height adjusting mechanism 82, the cleaning material 7 received by the notch 81 is stretched upward and the tension thereof is increased. Therefore, by using the adjusting rod 8 for adjusting the tension of the cleaning material 7, the tension of the cleaning material 7 when the cleaning material 7 is wound on the front winding wheel 5 and the rear winding wheel 6 becomes larger, so that the force for cleaning the spinning jet by the cleaning material 7 of the passive intermittent rotating assembly in the present invention becomes stronger accordingly. Furthermore, the cleaning material 7 can get into contact with the nozzle 21*a* more precisely and rotates more stably as the front winding wheel 5 rotates.

The embodiments of the present invention and various changes are described above with reference to the appended drawings, but the present invention is not limited to the foregoing descriptions. A person of ordinary skill may make equivalent variations based on the claims of the present invention. For example, in addition to an electrospinning equipment, the intermittent rotating assembly in the present invention may alternatively be applied to a plasma device or another device that needs to operate in a high-voltage environment or another device not suitable for being provided with an independent power source.

The above-described embodiments of the present invention are intended to be illustrative only. Numerous alternative embodiments may be devised by persons skilled in the art without departing from the scope of the following claims.

Symbol Description

1 Body portion
2 Spinning device
3 Push member
4 Main wheel
5 Front winding wheel
6 Rear winding wheel
7 Cleaning material
8 Adjusting rod
11 Movable device
12 Side wall portion
13 Front winding wheel support portion
14 Rear winding wheel support portion
21 Spinning jet
21*a* Nozzle
31 Push portion
40 Abutment member
40*a* Inner-side abutment portion
40*b* Outer-side abutment portion
41 First abutment member
41*a* First inner-side abutment portion
41*b* First outer-side abutment portion
41*b*1 Front endpoint of first outer-side abutment portion
41*b*2 Rear endpoint of first outer-side abutment portion
41*c* First front-side abutment portion
42 Second abutment member
42*a* Second inner-side abutment portion
42*a*1 Front endpoint of second inner-side abutment portion
42*a*2 Rear endpoint of second inner-side abutment portion
42*b* Second outer-side abutment portion
42*c* Second inner-side abutment portion
81 Notch
82 Height adjusting mechanism
d1 Gap between first abutment members in circumferential direction of main wheel
d2 Gap between second abutment members in circumferential direction of main wheel
ES Electrospinning equipment
IR Intermittent rotating assembly
R Reference region

What is claimed is:

1. A passive intermittent rotating assembly, comprising:

a cleaning material used for cleaning a spinning jet of a spinning device of an electrospinning equipment;

a front winding wheel and a rear winding wheel separately rotatably supported on the electrospinning equipment and provided for the cleaning material to be wound on;

a main wheel coaxially rotating with the front winding wheel, and abutment members being formed on an outer circumferential surface of the main wheel; and a push member supported by the spinning device to move back and forth along an axial direction of the main wheel with the spinning jet, and in a process of moving back and forth, a push portion of the push member abutting against the abutment members and pushing the main wheel to rotate in a rotation direction, wherein the abutment members comprise a plurality of first abutment members being arranged at an inner side of the main wheel along a circumferential direction, and being separated from each other to form first gaps for the push portion to pass through; and a plurality of second abutment members being arranged at an outer side of the main wheel along the circumferential direction, and being separated from each other to form second gaps for the push portion to pass through;

each of the plurality of first abutment members comprises a first inner-side abutment portion and a first outer-side abutment portion provided for abutting against the push portion and converging toward a direction opposite to the rotation direction of the main wheel;

each of the plurality of second abutment members comprises a second inner-side abutment portion and a second outer-side abutment portion provided for abutting against the push portion and converging toward the direction opposite to the rotation direction of the main wheel; and when observing from the axial direction of the main wheel, there is no gap in the circumferential direction between the first inner-side abutment portion and two second inner-side abutment portions adjacent to the first inner-side abutment portion or there is only a gap smaller than a half length of the push portion in a horizontal direction, and there is no gap in the circumferential direction between the first outer-side abutment portion and two second outer-side abutment portions adjacent to the first outer-side abutment portion or there is only a gap smaller than the half length of the push portion in the horizontal direction.

2. The passive intermittent rotating assembly according to claim 1, further comprising:

an adjusting rod configured to adjust a tension of the cleaning material wound on the front winding wheel and the rear winding wheel.

3. The passive intermittent rotating assembly according to claim 1, wherein each of the plurality of first abutment members has a first front-side abutment portion at a downstream side in the rotation direction of the main wheel;

each of the plurality of second abutment members has a second front-side abutment portion at the downstream side in the rotation direction of the main wheel;

the first front-side abutment portion and the second front-side abutment portion are formed in parallel to the axial direction of the main wheel; and a diameter of the push portion is substantially the same as the first gap between two of the plurality of first abutment members and the second gap between two of the plurality of second abutment members.

4. The passive intermittent rotating assembly according to claim 3, further comprising:

an adjusting rod configured to adjust a tension of the cleaning material wound on the front winding wheel and the rear winding wheel.

5. The passive intermittent rotating assembly according to claim 3, wherein in a top view, the shape of each of the plurality of first abutment members is substantially an inverted triangle formed by the first inner-side abutment portion, the first outer-side abutment portion, and the first front-side abutment portion; and in a top view, the shape of each of the plurality of second abutment members is substantially an inverted triangle formed by the second inner-side abutment portion, the second outer-side abutment portion, and the second front-side abutment portion.

6. The passive intermittent rotating assembly according to claim 1, wherein two ends of the second inner-side abutment portion in the circumferential direction are further forward and rearward respectively than the first gap between adjacent two of the plurality of first abutment members in the rotation direction of the main wheel; and two ends of the first outer-side abutment portion in the circumferential direction are further forward and rearward respectively than the second gap between two adjacent of the plurality of second abutment members in the rotation direction of the main wheel.

7. The passive intermittent rotating assembly according to claim 6, further comprising:

an adjusting rod configured to adjust a tension of the cleaning material wound on the front winding wheel and the rear winding wheel.

8. The passive intermittent rotating assembly according to claim 6, wherein each of the plurality of first abutment members has a first front-side abutment portion at a downstream side in the rotation direction of the main wheel;

each of the plurality of second abutment members has a second front-side abutment portion at the downstream side in the rotation direction of the main wheel;

the first front-side abutment portion and the second front-side abutment portion are formed in parallel to the axial direction of the main wheel; and a diameter of the push portion is substantially the same as the first gap between two of the plurality of first abutment members and the second gap between two of the plurality of second abutment members.

9. The passive intermittent rotating assembly according to claim 8, further comprising:

an adjusting rod configured to adjust a tension of the cleaning material wound on the front winding wheel and the rear winding wheel.

10. The passive intermittent rotating assembly according to claim 8, wherein in a top view, the shape of each of the plurality of first abutment members is substantially an inverted triangle formed by the first inner-side abutment portion, the first outer-side abutment portion, and the first front-side abutment portion; and in a top view, the shape of each of the plurality of second abutment members is substantially an inverted triangle formed by the second inner-side abutment portion, the second outer-side abutment portion, and the second front-side abutment portion.

11. An electrospinning equipment, comprising:

the passive intermittent rotating assembly according to claim 1;

a body portion comprising a movable device; and a spinning device comprising a spinning jet and moving back and forth horizontally by the movable device to get into contact with the cleaning material of the passive intermittent rotating assembly.

* * * * *